US007111917B2

(12) United States Patent
Hill et al.

(10) Patent No.: US 7,111,917 B2
(45) Date of Patent: Sep. 26, 2006

(54) PRESSURE PUMP SYSTEM

(75) Inventors: Rodney B. Hill, Silverton, OR (US); Edward F. Burress, Wilsonville, OR (US); Isaac Frazier, Portland, OR (US)

(73) Assignee: Xerox Corporation, Stamford, CT (US)

( * ) Notice: Subject to any disclaimer, the term of this patent is extended or adjusted under 35 U.S.C. 154(b) by 263 days.

(21) Appl. No.: 10/753,045

(22) Filed: Jan. 7, 2004

(65) Prior Publication Data

US 2005/0146572 A1 Jul. 7, 2005

(51) Int. Cl.
*B41J 2/195* (2006.01)
*B41J 2/175* (2006.01)

(52) U.S. Cl. ..... 347/7; 347/85

(58) Field of Classification Search ..... 347/7, 347/20, 30, 84, 85, 87
See application file for complete search history.

(56) References Cited

U.S. PATENT DOCUMENTS 4,558,326 A * 12/1985 Kimura et al. ..... 347/30
4,598,303 A * 7/1986 Peekema et al. ..... 347/71
5,646,666 A * 7/1997 Cowger et al. ..... 347/87

* cited by examiner

*Primary Examiner*—Ahn T. N. Vo
(74) *Attorney, Agent, or Firm*—Fay, Sharpe, Fagan, Minnich & McKee, LLP

(57) ABSTRACT

A system for delivering at least two distinct pressures to a print head of an ink jet printer includes a pump, a passage in communication with the pump and the print head, and a valve. The pump is for delivering positive pressure to the print head of the ink jet printer. The passage includes an opening, and the valve selectively opens and closes the opening.

16 Claims, 5 Drawing Sheets

PRESSURE PUMP SYSTEM

BACKGROUND

Ink jet printers create an image on a surface by ejecting ink through orifices in a print head face plate, which communicates with a print head. To provide fine image resolution, the ejected ink droplets are very small, as are the orifices. Since the orifices are very small, an orifice can be partially or completely blocked by an air pocket or a small particle.

Solid ink printers melt solid ink and deliver the melted ink to the print head. The melted ink travels through channels and chambers in the print head towards the reservoirs. When the solid ink printer is turned off, the ink that remains in the print head can freeze. When the ink thaws in the print head, air that was once in solution in the ink can come out of solution to form air bubbles or air pockets in the print head.

An obstructed orifice can result in unacceptable printing. The obstruction, be it an air pocket or a small particle, can usually be removed by purging the orifices. In known print heads, a vacuum attaches to the face plate of the print head and the obstruction is removed by imparting a negative pressure on the face plate. The vacuum system is complicated requiring many different parts. Accordingly, it is desirable to purge the orifices, as well as other channels and chambers in the print head, by introducing a positive pressure into the ink channels of the print head to eject obstructions out of the orifices and the ink channels leading to the orifices.

BRIEF DESCRIPTION

A system for delivering at least two distinct pressures to a print head of an ink jet printer includes a pump, a passage in communication with the pump and the print head, and a valve. The pump is for delivering positive pressure to the print head of the ink jet printer. The passage includes an opening, and the valve selectively opens and closes the opening.

DETAILED DESCRIPTION

A print head D for an ink jet printer A (FIG. 12) generally delivers liquid ink to a jet stack B (FIG. 13) that transfers the ink onto a drum C (FIG. 13). The print media, which can include paper, travels around the drum and picks up the ink deposited on the drum.

Figure 1:
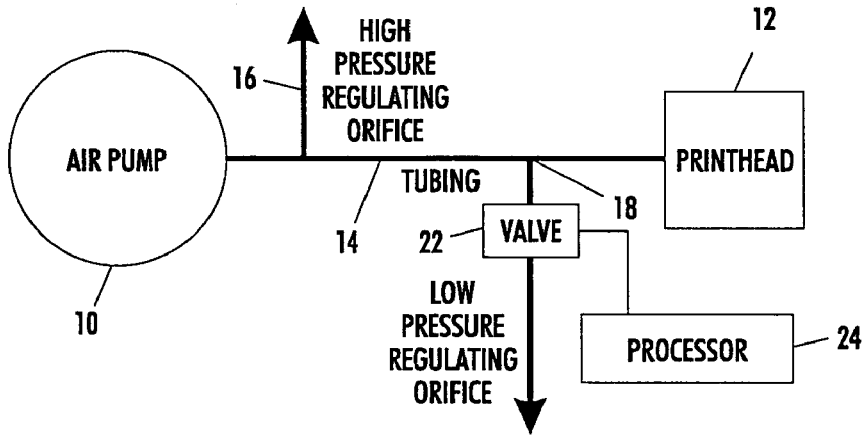
FIG. 1 is a schematic of a pump system that can deliver at least two distinct pressures.

With reference to FIG. 1, a pump 10 communicates with a print head 12 of an ink jet printer (not shown). The pump 10 in the exemplary embodiment is a rotary diaphragm air pump; however, other pumps can be used. The print head 12 includes a plurality of channels and cavities that direct liquid ink to orifices. Through these orifices, the liquid ink is ejected onto a drum where a print media, i.e. paper, rolls over the drum and picks up the ink forming an image on the print media. The print head is more particularly described in pending U.S. patent applications filed on the same date herewith, assigned to the same assignee as this application and entitled, "Print Head Reservoir Having Purge Vents," "Purgeable Print Head Reservoir," and "Valve for Printing Apparatus," each of which is incorporated by reference herein. The orifices, channels and cavities of the print head 12 are purged periodically. To purge the print head 12, air under pressure is introduced into the channels and cavities of the print head 12. After purging the surface in which the orifices are formed, e.g. the jet stack of the print head, can be wiped. Purge pressures are typically a few to several psi. Also, to prevent ink from being pushed back into the print head through the orifice during wiping, a low pressure assist pressure is usually delivered to the print head, which in an exemplary embodiment is about 0.04 psi. The pump 10 delivers air under pressure to the print head 12 at both the purge pressure and the assist pressure.

The pump 10 communicates with the print head 12 through a passage 14. The passage in the exemplary embodiment is plastic tubing. The passage 14 includes two openings to control the pressure being delivered to the print head 12. The pump 10 runs at a predetermined rate that delivers a known pressure through the passage 14 since the diameter, length and other characteristics of the passage are known. The pump in the exemplary embodiment runs at a rate that delivers a pressure through the passage 14 that is higher than the desired purge pressure of the print head. Accordingly, a first opening 16 is provided to bleed off a portion of the fluid, which in the exemplary embodiment is air, flowing through the passage, which results in a lower pressure being delivered to the print head. The size of the first opening 16 is determined using methods that are known in the art so that a desired purge pressure can be delivered to the print head 12 when the pump is running at a known rate. By providing the first opening 16, a commercially available pump that can only deliver a constant pressure that is higher than the desired purge pressure can be used to deliver the purge pressure. Furthermore, by bleeding off some of the fluid, the system minimizes noise, pressure spikes, etc., to deliver a more constant output pressure to the print head.

A second opening 18 is located downstream from the first opening 16. The second opening 18 allows fluid and/or pressure that was not bled off by the first opening 16 to bleed out of the second opening before traveling to the print head 12, thus the system can deliver a second lower predetermined assist pressure to the print head. The size of the second opening 18 is determined using methods that are known in the art so that a desired assist pressure can be delivered to the print head 12 when the pump is running at a known rate.

In the exemplary embodiment depicted in FIG. 1, the second opening 18 communicates with a valve 22 that selectively opens and closes the second opening 18. The valve in the exemplary embodiment is a solenoid valve; however, other conventional valves can also be used. The valve 22 communicates with a processor 24 that controls the valve.

Figure 2:
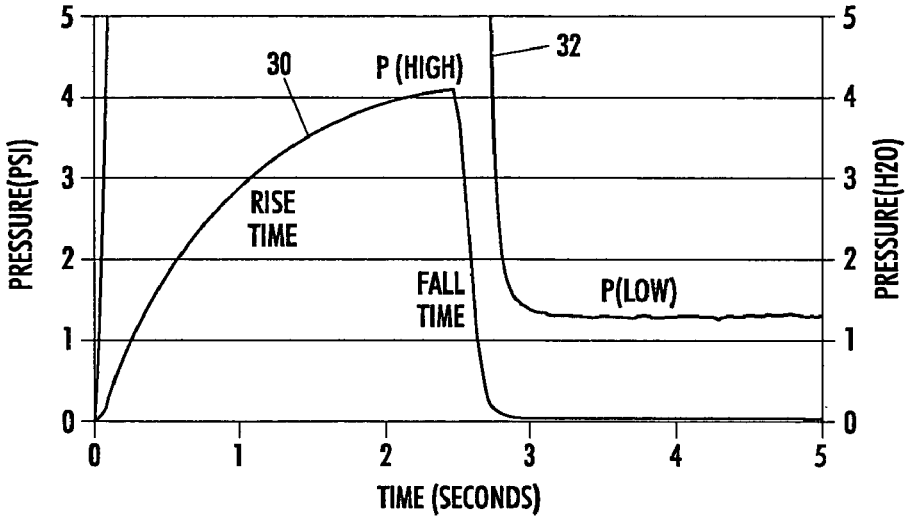
FIG. 2 is a graph of pressure versus time, in a dual pressure scale, for the pump system of FIG. 1.

With reference to FIG. 2, line 30 depicts the pressure rise during a purge cycle from time 0 to approximately 2.7 seconds. At time 0 the processor 24 delivers a signal to the valve 22 to close the opening 18. The pressure being delivered to the print head 12 during a purge cycle rises up to about 4.1 psi at 2.7 seconds. The processor 24, which includes a timer, opens the valve 22 at a predetermined time (2.7 seconds in this example), and air bleeds off through the passage 18 quickly lowering the pressure delivered to the print head to about 1.3 inches of water, as seen from line 32. Lines 30 and 32 represent the same purge cycle, but line 30 measures the pressure in psi and line 32 measures the pressure in inches of water. FIG. 2 is only one non-limiting example of a purge cycle for an ink jet printer. The shape of the lines 30 and 32 can and most likely will change when using a different pump or a passage having different dimensions or different sized openings.

The processor 24 has been described as opening the valve 22 at a predetermined time. This was used in the exemplary embodiment because it was found to be the most inexpensive method for delivering two distinct pressures to the print head. In an alternative embodiment, the valve 24 can automatically open at a predetermined pressure and remain open until the next purge cycle.

The processor 24 can also control the amount of power supplied to the pump. In this alternative, the processor can allow for the delivery of a higher amount of power from the power source to the pump 10 during the purge cycle. Once the valve 22 is opened, the processor 24 can allow for the delivery of a lower amount of power to the pump. The lower amount of power, however, should be enough power to allow the pump to deliver a constant or near constant pressure as shown in the nearly horizontal right hand portion of line 32 in FIG. 2. The pump 10 continues to run after the purge cycle and the second opening 18 bleeds off fluid to lower the pressure delivered to the print head 12 to the assist pressure.

Figure 3:
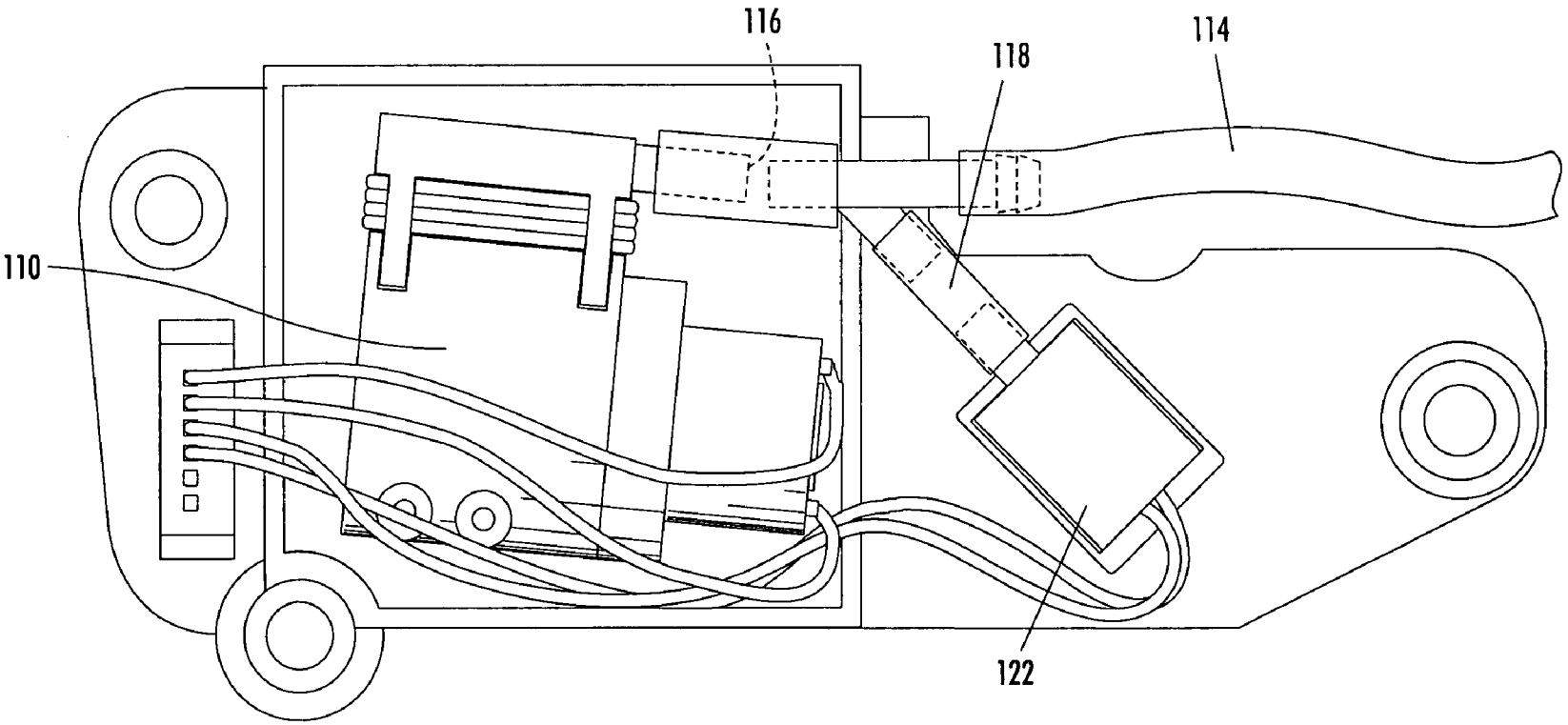
FIG. 3 is a perspective view of an alternative to the pump system of FIG. 1.
Figure 4:
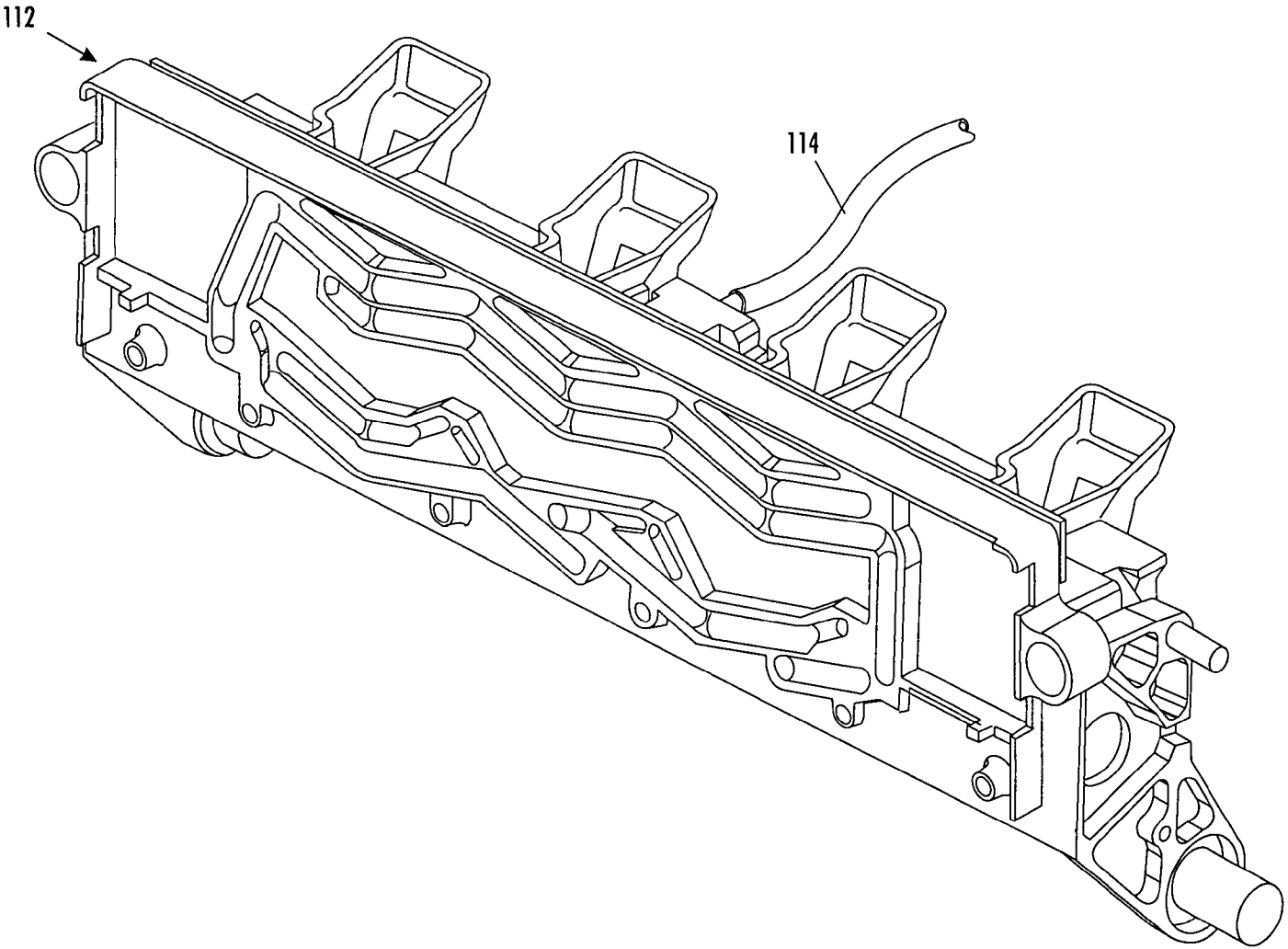
FIG. 4 is a perspective view of a portion of a print head of an ink jet printer and a tube that connects the print head to the pump system of FIG. 3.
Figure 5:
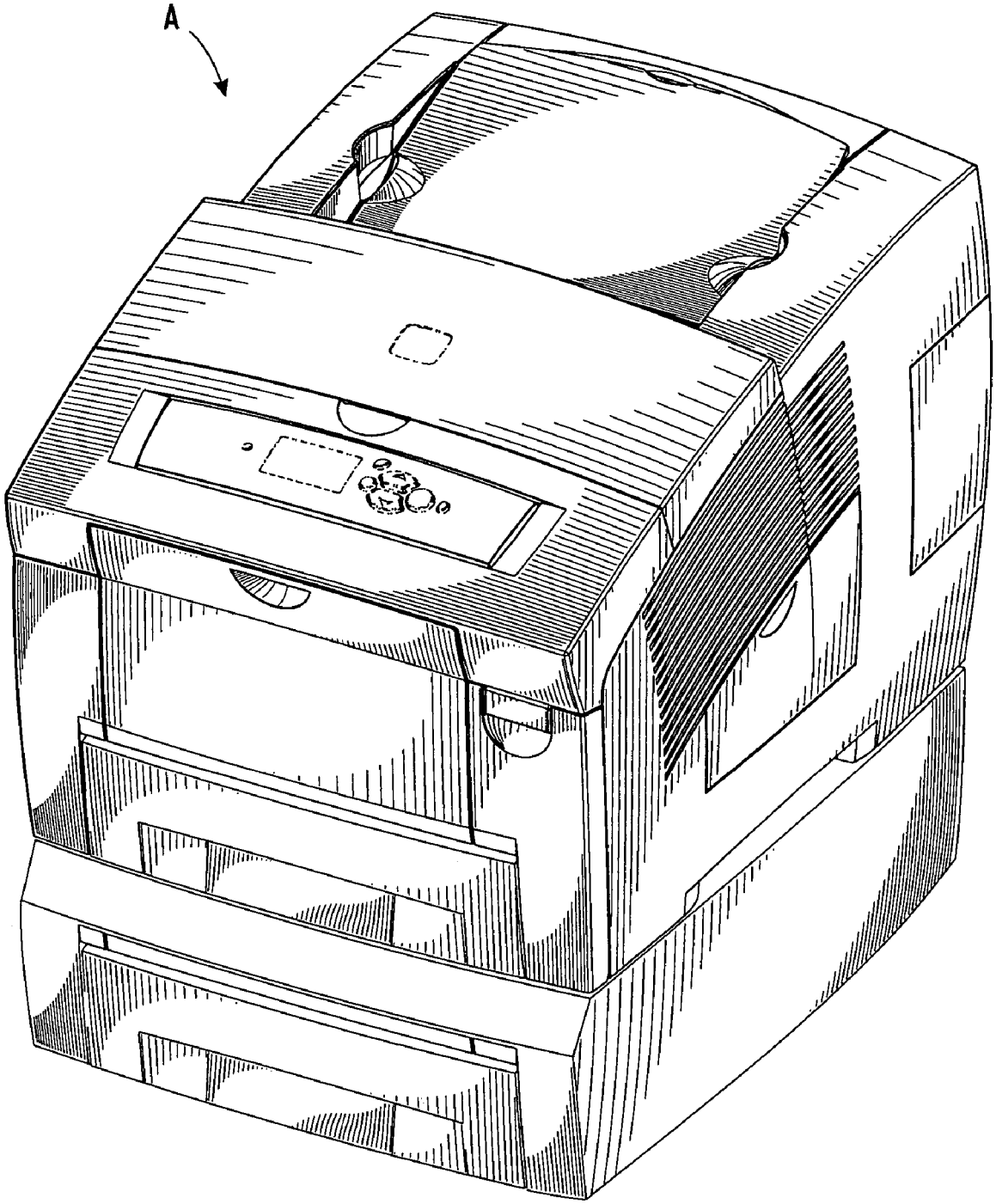
FIG. 5 is a perspective view of an ink jet printer that can contain the pump system of FIG. 1.
Figure 6:
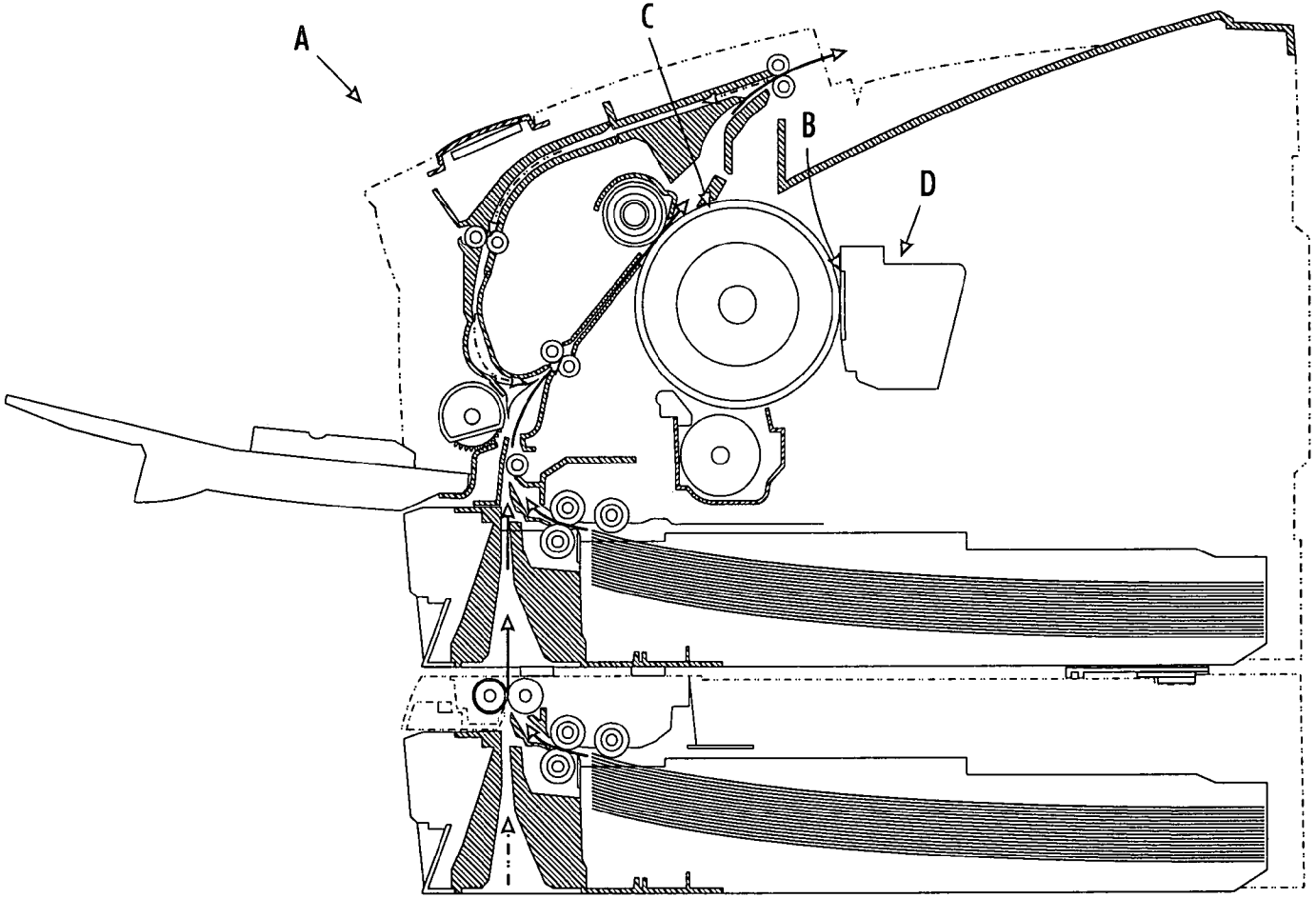
FIG. 6 is a side cross-sectional view of the inkjet printer of FIG. 5.

With reference to FIGS. 3 and 4, an alternative exemplary embodiment is depicted. A pump 110 communicates with a print head 112 (only a portion of the print head is depicted in FIG. 4) via a passage 114. In this embodiment, however, only one opening 118 is provided in the passage. The pump 110 includes a pump outlet 116 that is dimensioned to allow a predetermined amount of fluid at a certain velocity and/or at a predetermined pressure out of the pump outlet 116 and into the passage 114 to deliver the predetermined pressure to the print head 112. Instead of bleeding off fluid through an opening during the purge cycle, as described for the pump system above, the passage 114 is appropriately dimensioned with respect to the pump outlet 116 only to allow a certain pressure to be delivered to the print head 112. This first predetermined pressure is the purge pressure for the print head. Since the passage is dimensioned only to allow a certain amount of flow at a certain pressure, a back pressure can be exerted towards the pump 110.

The remainder of the pump system is similar to the system described above with reference to FIG. 1. As mentioned earlier, the pump system includes an opening 118 that can be selectively opened and closed by a valve 122, which is similar to the valve described above. Furthermore, the valve electronically communicates with a processor (not shown) to open and close the opening 118. The processor can also control the amount of power delivered to the pump, similar to that described in the previous embodiment.

The pump system has been described with reference to an ink jet printer; however, the pump system can also be used in other environments where one desires to deliver multiple different pressures to an apparatus. Additionally, the exemplary system has been described to deliver only two different pressures; however, by adding additional orifice and valve pairs, several different pressures can be delivered to an apparatus with a very inexpensive pressure system.

In yet another alternative embodiment, the valve 22 and 122 described above can open only partially so that the amount of fluid that bleeds out of the passage can be controlled. In this embodiment, a first opening does not need to be supplied in the passage since the valve can open to a first predetermined position to allow a certain amount of air to bleed off to deliver the purge pressure and then the valve can open further to allow more air to bleed out of the passage to deliver the assist pressure.

The exemplary embodiments have been described with reference to preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system for delivering at least two distinct pressures to a print head of an ink jet printer, the system comprising:
- a pump for delivering positive pressure to the print head of the ink jet printer;
- a passage in communication with the pump and the print head, wherein the passage includes an opening;
- a valve that selectively changes a size of the opening between an open and a closed position; and
- a processor including timer, the valve being in electronic communication with the processor to control the valve, the processor controls the valve based upon measuring time that the valve has been closed.

2. The system of claim 1, wherein the pump is a rotary motor driven diaphragm pump.

3. The system of claim 1, wherein the processor controls an amount of power delivered from an associated power source to the pump.

4. The system of claim 1, wherein the passage has a dimension such that a back pressure is exerted toward the pump.

5. The system of claim 1, wherein the passage includes an additional opening to bleed off fluid traveling through the passage.

6. An ink jet printer including the system of claim 1.

7. A method for delivering at least two distinct pressures to a print head of an ink jet printer, the method comprising:
- providing a pump in communication with a print head of an ink jet printer through a passage, wherein the passage includes an opening;
- pumping a fluid through the passage to deliver a first predetermined positive pressure to the print head; and
- selectively bleeding off the fluid through the opening in the passage to deliver a second predetermined positive pressure to the print head.

8. The method of claim 7, wherein the selectively bleeding step further includes bleeding off fluid through the opening for a predetermined amount of time.

9. The method of claim 7, wherein the selectively bleeding off step includes opening and closing a valve in response to a measured amount of time.

10. The method of claim 7, wherein the selectively bleeding off step includes opening and closing a valve in response to a measured pressure at the valve.

11. The method of claim 7, wherein the pumping step includes running the pump at a rate that is greater than a rate at which a desired pressure is delivered through the passage when a valve in closed.

12. The method of claim 7, wherein the selectively bleeding step includes continuing to pump fluid through the passage while selectively bleeding off the fluid.

13. A system for delivering pressure to a print head of an ink jet printer, the system comprising:

a pump for delivering fluid to the print head of the ink jet printer;

a passage in communication with the pump and the print head, the passage including an orifice upstream from the print head;

a valve operative between an open position and a closed position for selectively allowing the passage of fluid through the orifice; and a processor in electronic communication with the pump, wherein the processor controls an amount of power delivered from an associated power source to the pump.

14. The system of claim 13, wherein the processor is in communication with a timer and controls the valve based upon measuring time that the valve has been in the closed position.

15. The system of claim 13, wherein the processor is in electronic communication with the valve.

16. An ink jet printer including the system of claim 13.

* * * * *